US009301370B2

(12) United States Patent
Kim

(10) Patent No.: US 9,301,370 B2
(45) Date of Patent: Mar. 29, 2016

(54) POWER SUPPLY FOR LIGHT EMITTING DIODES (LEDS)

(75) Inventor: Sung Eun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 344 days.

(21) Appl. No.: 13/976,810

(22) PCT Filed: Oct. 11, 2011

(86) PCT No.: PCT/KR2011/007533
§ 371 (c)(1),
(2), (4) Date: Jun. 28, 2013

(87) PCT Pub. No.: WO2012/091258
PCT Pub. Date: Jul. 5, 2012

(65) Prior Publication Data

US 2013/0278154 A1 Oct. 24, 2013

(30) Foreign Application Priority Data

Dec. 27, 2010 (KR) ..... 10-2010-0136074

(51) Int. Cl.
*H05B 37/02* (2006.01)
*H05B 33/08* (2006.01)
*H05B 37/03* (2006.01)

(52) U.S. Cl.
CPC ..... *H05B 37/02* (2013.01); *H05B 33/0893* (2013.01); *H05B 37/036* (2013.01)

(58) Field of Classification Search
CPC ..... H05B 33/081; H05B 37/02451; Y02B 20/721; G06F 13/42
See application file for complete search history.

(56) References Cited

U.S. PATENT DOCUMENTS

| | | | | |
|---|---|---|---|---|
| 8,890,417 | B2 * | 11/2014 | Hu et al. | 315/122 |
| 2003/0034742 | A1 | 2/2003 | Chang et al. | 315/224 |
| 2006/0145631 | A1 | 7/2006 | Bao et al. | 315/244 |
| 2007/0278971 | A1 | 12/2007 | Ren et al. | 315/291 |
| 2008/0116818 | A1 | 5/2008 | Shteynberg et al. | 315/192 |
| 2008/0231198 | A1 | 9/2008 | Zarr | 315/119 |
| 2010/0091220 | A1 | 4/2010 | Lee et al. | 349/70 |

FOREIGN PATENT DOCUMENTS

| | | | |
|---|---|---|---|
| CN | 1798468 | A | 7/2006 |
| CN | 101083865 | A | 12/2007 |
| JP | 2005-109025 | A | 4/2005 |
| JP | 2005-261148 | A | 9/2005 |
| JP | 2010-124614 | A | 6/2010 |

(Continued)

OTHER PUBLICATIONS

International Search Report dated Apr. 4, 2012 issued in Application No. PCT/KR2011/007533.

*Primary Examiner* — Hai L Nguyen
(74) *Attorney, Agent, or Firm* — Ked & Associates, LLP

(57) ABSTRACT

A power supply is provided. The power supply includes at least one light emission unit, a power source, an openness detection circuit, and a feedback control unit. The at least one light emission unit includes a plurality of serially connected LEDs. The power source supplies a DC voltage to the light emission unit. The openness detection circuit varies a reference potential with a voltage which is detected from both ends of at least one of the LEDs in the light emission unit. The feedback control unit regulates an output current of the power source according to the reference potential of the openness detection circuit.

14 Claims, 3 Drawing Sheets

(56) References Cited

FOREIGN PATENT DOCUMENTS

| | | | |
|---|---|---|---|
| KR | 10-0728465 | B1 | 6/2007 |
| KR | 10-2009-0017145 | A | 2/2009 |
| KR | 10-2010-0039969 | A | 4/2010 |
| KR | 10-1005199 | B1 | 12/2010 |
| TW | 200838358 | A | 9/2008 |
| TW | 200906228 | A | 2/2009 |

* cited by examiner

POWER SUPPLY FOR LIGHT EMITTING DIODES (LEDS)

TECHNICAL FIELD

The present disclosure relates to a power supply.

BACKGROUND ART

Generally, Liquid Crystal Displays (LCDs) include two display substrates where an electric field applying electrode is displayed, and a liquid crystal layer that has dielectric anisotropy and is disposed between the two substrates. LCDs apply a voltage to an electric field applying electrode to generate an electric field in a liquid crystal layer, change the voltage to adjust intensity of the electric field, and thus adjust a transmittance of light passing through the liquid crystal layer, thereby displaying a desired image.

Since LCDs cannot self emit light, the LCDs require a separate light source called a backlight, and the light source is being replaced by Light Emitting Diodes (LEDs).

Since LEDs are semiconductor devices, LEDs have long service life, fast lighting speed, low consumption power, and excellent color reproductivity. Moreover, LEDs are robust to impact, and facilitate the miniaturizing and thinning of LEDs. Therefore, a backlight using LEDs are being mounted on medium and large LCDs such as computer monitors and televisions (TVs), in addition to small LCDs mounted on mobile phones, etc.

DISCLOSURE OF INVENTION

Technical Problem

Embodiments provide a power supply with a new openness detection circuit.

Embodiments also provide a power supply which detects a circuit-opened state of at least one LED included in a light emission unit having a plurality of LEDs, thereby regulating a supplied power.

Embodiments also provide a power supply which automatically varies a supplied current according to a circuit-opened state of an arbitrary LED in a light emission unit.

Solution to Problem

In one embodiment, a power supply includes: at least one light emission unit including a plurality of serially connected Light Emitting Diodes (LEDs); a power source supplying a Direct Current (DC) voltage to the light emission unit; an openness detection circuit varying a reference potential with a voltage which is detected from both ends of at least one of the LEDs in the light emission unit; and a feedback control unit regulating an output current of the power source according to the reference potential of the openness detection circuit.

Advantageous Effects of Invention

According to embodiments, a light emission unit including LEDs and a lighting system such as a light unit including the light emission unit can be improved in reliability.

According to embodiments, a normally driven LED can be protected.

According to embodiments, by detecting a circuit-opened state of an arbitrary LED to automatically vary a supplied current, provided can be an openness detection circuit corresponding to a circuit-opened state of a light emission unit.

MODE FOR THE INVENTION

Hereinafter, embodiments of the present disclosure will be described below in more detail with reference to the accompanying drawings.

Figure 1:
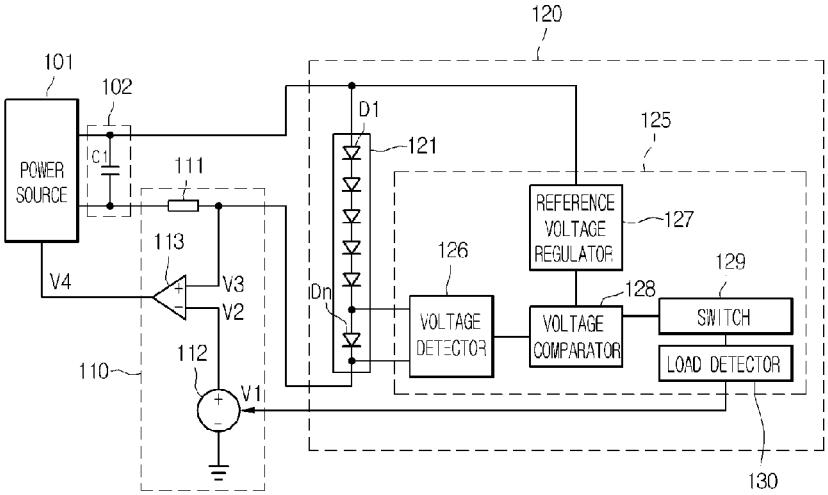
FIG. 1 is a circuit diagram illustrating a power supply according to an embodiment.

Referring to FIG. 1, a power supply according to an embodiment includes a power source 101, a light emission module 120 including at least one light emission unit 121, and a feedback control unit 110.

The power source 101 may supply a Direct Current (DC) voltage, for example, include a switched-mode power supply (SMPS). The power supply includes a filter 102 that is connected to an output terminal of the power source 101 in parallel. The filter 102 includes a capacitor C1, and removes a ripple included in the DC voltage.

The light emission module 120 includes at least one board, which includes at least one light emission unit 121. The board may be a flexible substrate, a rigid substrate, or a metal core Printed Circuit Board (PCB), a material of which may be resin or ceramic, but the embodiment is not limited thereto.

Each board includes at least one light emission unit 121, each of which includes a plurality of light emitting diodes LD1 to LDn. The light emitting diodes LD1 to LDn may be connected in series. Herein, when each board includes the plurality of light emission units 121, the light emission units 121 may be connected in parallel.

Each of the light emitting diodes LD1 to LDn is LED is an LED, and may emit light of a visible light band such as blue, red, green, and white or emit light of a ultraviolet (UV) band. However, the embodiment is not limited thereto.

Input terminals of the respective light emission units 121 are connected to a positive polarity terminal of the power source 101 in common, and output terminals of respective light emission units 121 are connected to a negative polarity terminal of the power source 101 in common. The number of LEDs LD1 to LDn in each light emission unit 121 may vary according to a voltage supplied from the power source 101, but the embodiment is not limited thereto. A current flowing through each light emission unit 121 is transferred to the power source 101 through a current regulator 111 of the feedback control unit 110.

The light emission module 120 may include an openness detection circuit 125, which may be disposed on each board or a main board, but the embodiment is not limited thereto.

The openness detection circuit 125 includes a voltage detector 126, a reference voltage regulator 127, a voltage comparator 128, a switch 129, and a load detector 130. The openness detection circuit 125 detects whether each light emission unit 11 is circuit-opened and outputs a control voltage. The feedback control unit 110 includes a reference potential unit 112 and a comparator 113. The feedback control unit 110 may change an output of the comparator 113 to disconnect an output of the power source 101 or regulate an output current, according to the control voltage.

The reference voltage regulator 127 may be connected to an input terminal of each light emission unit 121 to operate according to a voltage inputted to each light emission unit 121. As another example, the reference voltage regulator 125 may receive another voltage to operate. The voltage detector 126 is connected to both ends of at least one LED LDn, namely, an anode and cathode thereof. The voltage detector 126 may check a voltage that is applied across both ends of the LED LDn, and detect a voltage when the LED LDn is in an opened state or a normal state. The voltage comparator 128 compares a voltage detected by the voltage detector 126 with a reference voltage of the reference voltage regulator 127, and outputs a control signal according to the compared result.

When the Nth LED LDn connected to the voltage detector 126 is opened, the voltage comparator 128 turns on/off the switch 129 with the voltage detected by the voltage detector 126, thereby varying reference potential V1.

When any one of the LEDs LD to LDm is opened instead of the Nth LED LDn connected to the voltage detector 126, the voltage comparator 128 turns on/off the switch 129 with the voltage detected by the voltage detector 126, thereby varying reference potential V1. Herein, the LEDs LD1 to LDn of the light emission unit 121 may be divided into a first group of the LEDs LD1 to LDm and a second group including the LED LDn. The LEDs LD1 to LDm of the first group are LEDs other than the LED LDn connected to both ends of the voltage detector 126, and the LED LDn of the second group is an LED other than those of the first group Herein, the LEDs LD1 to LDn are divided into the first and second groups, but the embodiment is not limited thereto. For example, the LEDs LD1 to LDn may be divided into two or more groups. Also, the second group may be connected to detect a voltage across both ends of a plurality of LEDs.

The voltage comparator 128 may output a first voltage of the voltage detector 126 or a second voltage of the reference voltage regulator 127. The switch 129 is turned on/off according to the control signal of the voltage comparator 128 such as the first or second voltage. The load detector 130 varies the reference potential V1 according to the turn-on/off of the switch 129.

The reference potential unit 112 of the feedback control unit 110 outputs a reference potential of the load detector 130. The comparator 113 compares the reference potential V1 inputted to a first terminal(−) and a voltage V3 inputted to a second terminal(+) and outputs a signal V4 to the power source 101 according to the compared result. The voltage V3 inputted to a second terminal(+) of the comparator 113 is a voltage applied to an output terminal of the light emission unit 121 or a voltage applied to the current regulator 111. The current regulator 111 includes a resistor, and senses the fine change of a current flowing in the current regulator 111, thereby allowing a constant current to flow in the LEDs LD1 to LDn of the light emission unit 121.

An output of the comparator 113 varies according to the change of the reference potential V1, and an output V4 of the comparator 113 controls an output current of the power source 101. The feedback control unit 110 may disconnect, increase or decrease the output current of the power source 101. For example, the feedback control unit 110 increases the output V4 of the comparator 113 when the reference potential V1 outputted from the openness detection circuit 125 is reduced, but the output V4 of the comparator 113 decreases when the reference potential V1 increases.

The power source 101 regulates a current value of the DC power source according to the output V4 of the comparator 113. For example, when the output V4 of the comparator 113 increases, the power source 101 decreases a supply current. Also, the power source 101 increases the supply current in inverse proportion to the decrease in the output V4 of the comparator 113. The power source 101 may disconnect or decrease a current according to the reference potential V1 that is supplied from the feedback control unit 110 based on an opened state.

According to the embodiment, the power supply may detect an opened state of any one of the LEDs LD1 to LDn in the light emission unit 121, and feed back the control signal to the power source 101 to regulate the output current of the power source 101 according to whether the one LED is opened.

Moreover, in the embodiment, the openness detection circuit 125 of the one light emission module 120 has been described above, but respective openness detection circuits 125 of the plurality of light emission modules 120 may be disposed. A reference potential V1 of each openness detection circuit 125 may vary. Therefore, the feedback control unit 110 may disconnect, increase or decrease the output current of the power source 101 according to the reference potential V1 of each openness detection circuit 125.

Hereinafter, current and voltage characteristics of an LED array will be described in detail with reference to FIGS. 2 to 4.

Figure 2:
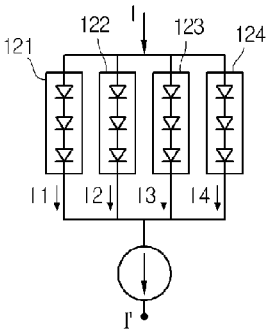
FIG. 2 is a circuit diagram illustrating an example of a constant current control method according to an embodiment.

Referring to FIG. 2, a plurality of LEDs in each of light emission units 121 to 124 are connected in series. An input current I is distributed to the light emission units 121 to 124, and thus, the same level of currents I1 to I4 flow in the light emission units 121 to 124, respectively. For example, when the input current I is about 1000 mA, the currents I1 to I4 OF about 250 mA flow in the light emission units 121 to 124, respectively. Furthermore, the currents of the respective light emission units 121 to 124 are summed in output terminals of the respective light emission units 121 to 124, and thus, an output current I of about 1000 mA is sensed. In this way, by setting a reference output current according to a total capacity of the parallel-connected light emission units 121 to 124, the reference output current is controlled as a constant current.

Figure 3:
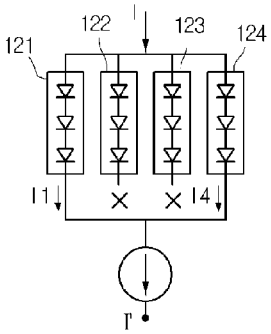
FIG. 3 is a circuit diagram illustrating the flow of a current based on the opening of a light emission unit in the circuit diagram of FIG. 2.

Referring to FIG. 3, when an LED circuit of each of second and third light emission units 122 and 123 among a plurality of light emission units 121 to 12*n* is opened, a current does not flow in the second and third light emission units 122 and 123. At this point, when the input current I is continuously supplied at about 1000 Ma, currents I1 and 14 of about 500 mA flow in the first and fourth LEDs 121 and 124, respectively. As described above, even when LED circuits of the respective light emission units 122 and 123 are opened, namely, a load capacity is reduced, currents respectively supplied to the light emission units 121 to 124 maintain a level of a current outputted from the power source 101, and thus, currents flowing in respective LEDs of the light emission units 121 and 124 increase. Heating in LEDs of the normal light emission units 121 and 124 more increases by an increased current. This accelerates the deterioration of LEDs and shortens the service life of the LEDs. When the LEDs of the light emission units 121 and 124 are opened, an overcurrent exceeding a rated current may be generated. Also, the heating of LEDs may more increases, and a soldering crack being a soldered portion may occur. Due to this reason, electrical spark occurs, causing fire.

According to the embodiment, when an LED of at least one light emission unit is opened, the power supply detects an opened state to decrease or disconnect a current outputted from the power source 101, thus protecting LEDs.

Figure 4:
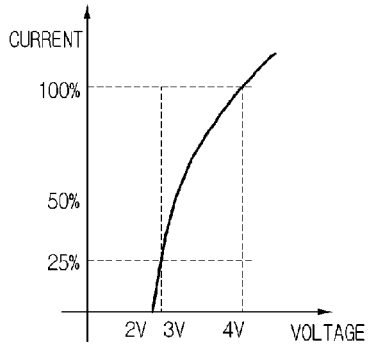
FIG. 4 is a graph showing a relationship between a voltage and a current which flow in a light emission unit.

As illustrated in FIG. 4, voltage-current characteristics of an LED show that an input current is largely changed even when an input voltage is slightly changed. As a voltage becomes higher, a change slope increases sharply. Therefore, even when an LED circuit of a light emission unit is opened, the power supply controls or disconnects a current with the openness detection circuit such that a constant current flowing in each light emission unit is maintained without abnormal increase. Accordingly, constant brightness can be controlled, and LEDs can be protected.

Figure 5:
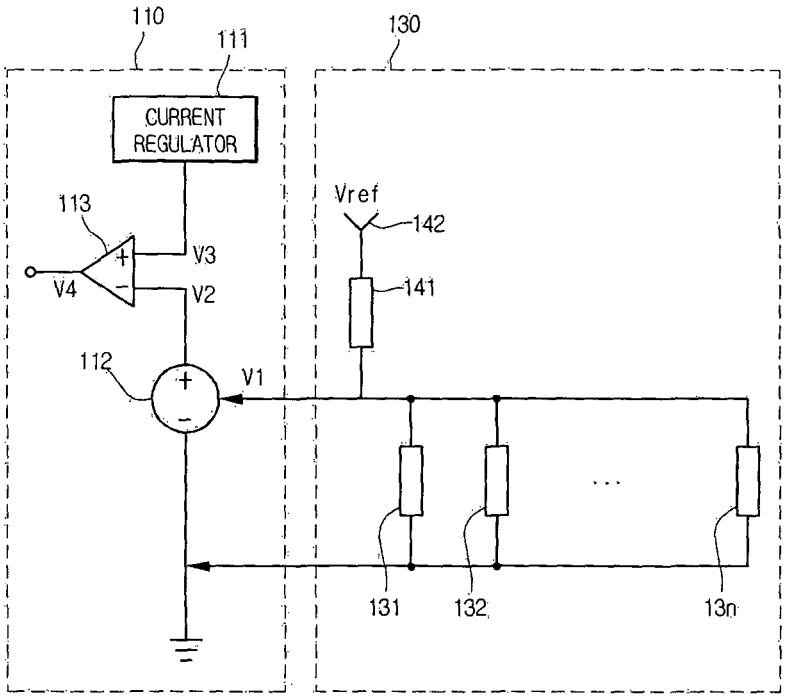
FIG. 5 is a circuit diagram illustrating an example of a power supply for detecting an opened state of each light emission unit according to an embodiment.

FIG. 5 is a circuit diagram illustrating in detail the openness detection circuit of FIG. 1. Referring to FIG. 5, both ends of the light emission unit 121 are respectively connected to both ends of the power source 101 of FIG. 1, and receives a DC voltage. The input terminal of the light emission unit 121 may be connected to a voltage terminal 140 of the reference voltage regulator 127, and its description refers to the above description of FIG. 1.

The voltage detector 126 includes a resistor R7, and is connected to both ends of the LED LDn of the second group. The resistor R7 is connected to an anode and cathode of the LED LDn of the second group in parallel. When the LED LDn of the second group is opened, the voltage detected by the voltage detector 126 is a high voltage, for example, is higher than a voltage that is applied to the LED LDm of the first group in a normal operation.

Also, when at least one of the LEDs LD1 to LDm in the first group is opened, the voltage detected by the voltage detector 126 as a low voltage is lower than a voltage that is applied to the LED LDn of the second group in a normal operation, for example, is detected as 0 V.

The reference voltage regulator 127 receives a voltage supplied from the power source 101 to each light emission unit 121 or receives a separate voltage 140 to operate. The reference voltage regulator 127 includes a first switch element Q1. The first switch element Q1 has a base that is connected to the voltage 140 through a resistor R9, and a collector that is connected to the voltage 140 through a resistor R8. A Zener diode Z3 and a capacitor C1 are connected in parallel between the base and a ground terminal. The first switching element Q1 is turned on/off by a second switching element Q2 of the voltage comparator 128. An emitter of the first switching element Q1 is connected to an emitter of the second switching element Q2. When the second switching element Q2 is turned on, the first switching element Q1 is turned on. On the contrary, when the second switching element Q2 is turned off, the first switching element Q1 is turned off.

At least one of the first and second switching elements Q1 and Q2 may be configured with a Bipolar Junction Transistor (BJT) or a Metal Oxide Semiconductor Field Effect Transistor (MOSFET).

In the voltage comparator 128, a resistor R15 is connected to a base of the second switching element Q2, an anode of a diode D6 is connected to the resistor R15, and a cathode of the diode D6 is connected to one end of the resistor R7 of the voltage detector 126. The switch 128 includes a first voltage output unit 128A. The first voltage output unit 128A outputs a first voltage when the voltage detector 126 detects a high voltage, but a current I2 is disconnected when a voltage lower than the high voltage is inputted thereto. Herein, the first voltage output unit 128A includes a resistor R4 connected to a collector of the second switching element Q2, a Zener diode Z2 having an anode connected to the resistor R4, and a diode D2 having a cathode connected to a cathode of the Zener diode Z2. An anode of the diode D2 is connected to one end of the resistor R7. The Zener diode Z22 can disconnect an abnormal voltage and thus prevent an abnormal operation of a switch 129.

The first voltage output unit 128A outputs the voltage detected by the voltage detector 126 when the LED LDn of the second group is opened, in which case the first voltage is a voltage in which drop voltages of diodes are not reflected and may be lower than the voltage detected by the voltage detector 126.

The second switching element Q2 serves as a second voltage output unit. When the LEDs LD1 to LDn of the first group are opened, the voltage applied to the voltage detector 126 becomes a low voltage, which is applied to the base of the second switching element Q2, and thus, the second switching element Q2 is turned on.

Therefore, the second switching element Q2 outputs a voltage, inputted to the first switching element Q1, as a second voltage through a collector thereof. The second switching element Q2 of the voltage comparator 128 is driven by an abnormal voltage detected by the voltage detector 126.

A resistor R11 and a capacitor C2 are connected to the output terminal of the voltage comparator 128 in parallel to serve as a filter. The switch 129 includes a third switching element Q3. The third switching element Q3 has a gate connected to the voltage comparator 128, a drain connected to a first node N1, and a source connected to a second node N2 connected to the ground terminal. The third switching element Q3 may be configured with a BJT or a MOSFET.

The load detector 130 is connected to an output terminal of the switch 129, and controls the reference potential V1 according to the turn-on/off of the switch 129.

Herein, a drain of the third switching element Q3 is connected to a load resistor 131 and reference resistor Rf of the load detector 130. Another end of the load resistor 131 is connected to the ground terminal, and another end of the reference resistor Rf is connected to a reference voltage (Vref) 142. Herein, the reference resistor Rf and the reference voltage 142 are not included in the load detector 130, but may be included in the feedback control unit 110 (see FIG. 1). However, the embodiment is not limited thereto.

A first node N1 being the drain of the third switching element Q3 and a second node N2 being a source of the third switching element Q3 are connected to the load resistor 131, which outputs a reference potential V1 to a reference potential unit 112 according to the turn-on/off of the third switching element Q3.

The third switching element Q3 is turned on/off by an input voltage of the gate thereof. When at least one group among the LEDs LD1 to LDn of the light emission unit 121 is opened, the third switching element Q3 is turned on. When at least one group among the LEDs LD1 to LDn of the light emission unit 121 is not opened, the third switching element Q3 is turned off.

When the third switching element Q3 is turned on, the reference potential V1 applied to the load resistor 131 becomes a low voltage. When the third switching element Q3 is turned off, the reference potential V1 applied to the load resistor 131 becomes a high voltage or a normal voltage.

The reference potential V1 is inputted to the second terminal(−) of the comparator 113 through the reference potential unit 112 of the feedback control unit 110 of FIG. 1, and thus varies the output V4 of the comparator 113. Since the output V4 of the comparator 113 varies, an output current of the power source 101 is disconnected or reduced.

Herein, the first node N1 is connected to a first node N1 of another light emission module, and the second node N2 is connected to a second node N2 of the other light emission module. Therefore, the load resistor 131 may be connected to nodes N1 and N2 of each of a plurality of light emission modules in parallel, and detect whether openness occurs in the light emission modules by a parallel resistance value. Also, since the reference potential V1 varies according to a parallel resistance value of the load resistor 131, currents respectively flowing in the light emission units can be regulated.

Figure 6:
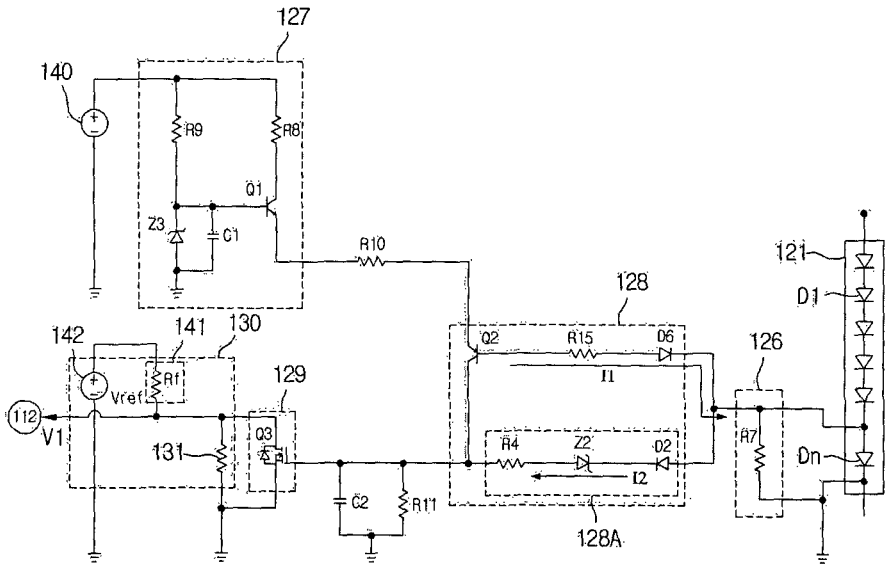
FIG. 6 is a circuit diagram illustrating another example of a power supply for detecting an opened state of each light emission unit according to an embodiment.

FIG. 6 is a circuit diagram illustrating a circuit for detecting an output current and opened state of each light emission unit, as another example of FIG. 5.

Referring to FIG. 6, an openness detection circuit 125A is a modified example of a switch 129A. The switch 129A includes third and fourth switching elements Q3 and Q3. A gate of the third switching element Q3 is connected to the voltage comparator 128, a drain of the third switching element Q3 is connected to a base of a first switching element Q1 of the reference voltage regulator 127, and a source of the third switching element Q3 is connected to a ground terminal.

A gate of the fourth switching element Q4 is connected to the drain of the third switching element Q3 and a base of the first switching element Q1, a drain of the fourth switching element Q4 is connected to the load resistor 131, and a source of the fourth switching element Q4 is connected to the ground terminal.

When at least one of the LEDs LD1 to LDn in the light emission unit 121 is opened, the third switching element Q3 of the switch 129A is turned on, and the fourth switching element Q4 is turned off. At this point, a reference potential V1 applied to the load resistor 131 of the load detector 130 is outputted as a high voltage. On the contrary, when all the LEDs LD1 to LDn of the light emission unit 121 are normal, the third switching element Q3 is turned off, and the fourth switching element Q4 is turned on. At this point, the reference potential V1 applied to the load resistor 131 of the load detector 130 is outputted as a low voltage.

The switch 129A is turned on by a voltage when the LEDs of each light emission unit 121 are opened, the reference potential V1 of the load detector 130 is outputted as a high voltage. Also, the switch 129A is turned off when the LEDs of each light emission unit 121 are normal, the reference potential V1 of the load detector 130 is outputted as a low voltage. The feedback control unit 110 of FIG. 1 outputs a low signal to the power source 101 when the reference potential V1 of the load detector 130 is high. At this point, the power source 101 decreases or disconnects an output current according to the low signal of the feedback control unit 110.

Figure 7:
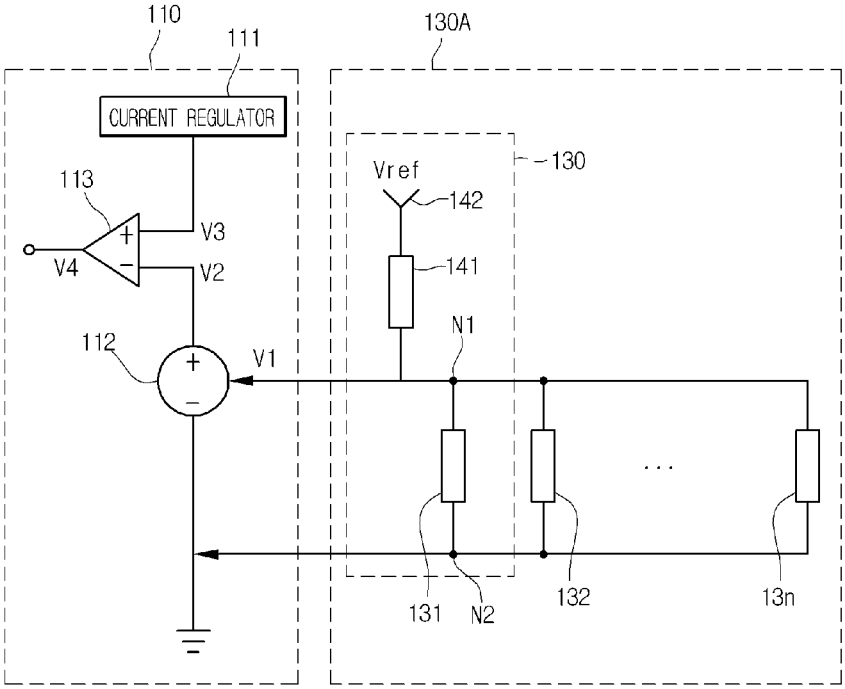
FIG. 7 is a circuit diagram illustrating a power supply for detecting opened states of a plurality of light emission units according to an embodiment.

Herein, the load resistor 131 of the load detector 130, as illustrated in FIG. 7, may be connected to a plurality of load resistors 132 to 13*n* in each light emission unit in parallel. In this case, the reference potential V1 varies according to a parallel resistance value of the load resistors in the load detector 131, and thus, an output current inputted to each of the light emission units 121 to 12*n* is regulated according to the change of the reference potential V1. That is, the feedback control unit 110 may vary the output current of the power source 101 according to the reference potential V1 of the load detector 130. For example, when a current of about 1000 mA is distributed to four light emission units, about 250 mA is supplied to each of the fourth light emission units. Furthermore, when five light emission units are connected, the feedback control unit 110 increases the output current to about 1250 mA such that about 250 mA instead of 200 mA is supplied to each of the five light emission units.

In FIGS. 1, 5 and 6, a load detector of an openness detection circuit connected to one light emission unit detects a load state from the load resistor 131. In FIG. 7, however, a load detector 130A may detect the opened states of all light emission units from a plurality of load resistors 131 to 13*n*, and an output current supplied to all the light emission units are regulated.

The load resistors 131 to 13*n* are connected to an openness detection circuit of each light emission unit, and connected to each other in parallel. That is, each of the load resistors 131 to 13*n* is a load resistor of an openness detection circuit connected to each light emission unit. In the circuit diagram of FIG. 5, the load resistors 131 to 13*n* may be connected to the first and second nodes N1 and N2 of the load detector 130 in parallel. Herein, the openness detection circuit of each light emission module may use a reference voltage 142 and a reference resistor 141 in common.

The feedback control unit 110 of FIG. 1 may detect an opened state of an LED from the load detector 130A to disconnect a current supplied to each light emission unit, and regulate a current supplied to each light emission unit according to a parallel resistance value.

Figure 8:
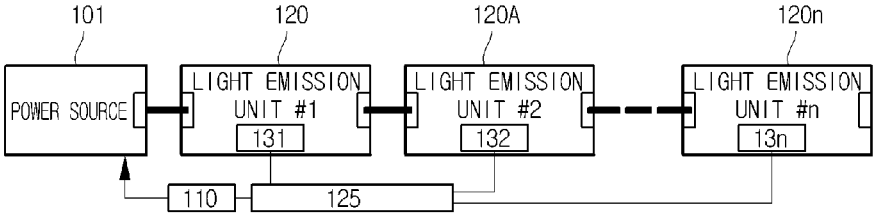
FIG. 8 is a diagram illustrating a light emitting device according to an embodiment.

Referring to FIG. 8, the power source 101 and one board B1 may be connected through connectors 151 and 152, and a plurality of boards B1 to Bn may be connected through connectors 152 and 153. A plurality of light emission units 121 to 12*n* respectively disposed in the boards B1 to Bn may be connected to each other in parallel, in which case the connection may be implemented as wiring of the boards B1 to Bn. In each of the light emission units 121 to 12*n*, a plurality of LEDs are connected in series.

The respective boards B1 to Bn, the respective light emission units 121 to 12*n*, and the respective openness detection circuits 125 may be defined as the respective light emission modules 120 to 12*n*.

The openness detection circuit 125 may be disposed in the light emission unit of each of the boards B1 to Bn. Such a structure is an example. As another example, the openness detection circuit 125 may be disposed on a main board instead of the boards B1 to Bn, but the embodiment is not limited thereto.

A voltage (which is detected by each of a plurality of openness detection units 125) based on whether each light emission unit is opened varies a reference potential of an integrated load detector 130A, which varies the output of the feedback control unit 110, and thus, the output current of the power source 101 is disconnected, decreased, increased.

Herein, the integrated load detector 130A is disposed to be separated from the openness detection circuit 125. This is an exemplary configuration for convenience.

The feedback control unit 110 may detect whether the light emission units 121 to 12*n* are opened with a reference potential value of the integrated load detector 130A. The openness detection circuit 125 may detect the increase or decrease in the number of the boards B1 to Bn with a parallel resistance value of each board and regulate an output current suitable for the number of boards. That is, one load resistor is disposed in each board, and when load resistors of respective boards are connected in parallel, a load resistance value is changed in the circuit diagrams of FIGS. 6 and 7. Whether the number of boards increases or decreases according to the change of a reference potential may be checked with the changed load resistance value, and thus, the output current of the power source 101 may increase or decrease. Also, the changed of an individual board is sensed with the change of an individual load resistance value, and thus, the output current of the feedback control unit 110 is changed in proportion to a board increment or decrement. Connectors between the boards B1 to Bn may be directly or indirectly connected to each other, but the embodiment is not limited thereto.

The above-described power supply may be applied to a plurality of lighting systems such as backlight units, various kinds of display devices, headlamps, streetlamps, indoor lamps, outdoor lamps, signal lights, and lighting lamps.

In the embodiments, the above-described features, structures, and effects are included in at least one embodiment, but are not necessarily limited to one embodiment. Furthermore, the features, structures, and effects that have exemplified in each embodiment may be combined or modified by those skilled in the art and implemented. Therefore, it should be construed that contents related to the combination and modification are included in the spirit and scope of the embodiments.

According to embodiments, a light emission unit including LEDs and a lighting system such as a light unit including the light emission unit can be improved in reliability.

According to embodiments, a normally driven LED can be protected.

According to embodiments, by detecting a circuit-opened state of an arbitrary LED to automatically vary a supplied current, provided can be an openness detection circuit corresponding to a circuit-opened state of a light emission unit.

While this invention has been particularly shown and described with reference to preferred embodiments thereof, it will be understood by those skilled in the art that various changes in form and details may be made therein without departing from the spirit and scope of the invention as defined by the appended claims. For example, each element specifically illustrated in embodiments can be modified and implemented. Therefore, it should be construed that differences related to the combination and modification are included in the spirit and scope of the embodiments.

The invention claimed is:

1. A power supply comprising:

at least one light emission unit comprising a plurality of serially connected Light Emitting Diodes (LEDs);

a power source supplying a Direct Current (DC) voltage to the light emission unit;

an openness detection circuit varying a reference potential with a voltage which is detected from both ends of at least one of the LEDs in the light emission unit; and a feedback control unit regulating an output current of the power source according to the reference potential of the openness detection circuit, wherein the openness detection circuit comprises:

a voltage detector connected to both ends of the at least one LED;

a reference voltage regulator outputting a reference voltage;

a voltage comparator outputting at least one of outputs of the reference voltage regulator and voltage detector according to the voltage detected by the voltage detector;

a switch turning on or off according to the output of the voltage comparator; and a load detector outputting different reference potentials to the feedback control unit according to an operating state of the switch.

2. The power supply according to claim 1, wherein a resistor and a capacitor are connected to an output terminal of the voltage comparator in parallel.

3. The power supply according to claim 1, wherein, the voltage detector is connected to both ends of a last LED, and the reference voltage regulator is connected to an input terminal of the light emission unit.

4. The power supply according to claim 1, wherein the voltage comparator comprises:

a first voltage output unit outputting a first voltage to drive the switch, according to a first level of voltage detected by the voltage detector; and a switching element outputting a second voltage, inputted from the reference voltage regulator, to drive the switch, according to a second level of voltage detected by the voltage detector.

5. The power supply according to claim 4, wherein, the first voltage output unit outputs a first voltage by a circuit-openness of the at least one LED, and the switching element outputs a second voltage by a circuit-openness of the LEDs other than the at least one LED.

6. The power supply according to claim 1, wherein the load detector comprises a load resistor outputting different reference potentials according to the turn-on or turn-off of the switch.

7. The power supply according to claim 6, wherein, the light emission unit and the openness detection circuit are in plurality, and the load detector comprises a plurality of load resistors which are disposed in each of the openness detection circuits and connected to each other in parallel.

8. The power supply according to claim 7, wherein the switch comprises:

a first switching element turning on or off according to the output of the voltage comparator; and a second switching element operating contrary to an operation of the first switching element to change a reference potential of the load detector.

9. The power supply according to claim 8, wherein the first voltage output unit comprises:

a resistor connected to a collector of the second switching element;

a Zener diode having an anode connected to the resistor;

a diode having a cathode connected to a cathode of the Zener diode, an anode of the diode being connected to one end of the resistor.

10. The power supply according to claim 8, wherein the switch comprises third and fourth switching elements, the third switching element having: a gate connected to the voltage comparator; a drain connected to a base of the first switching element of the reference voltage regulator; and a source connected to a ground terminal, and the fourth switching element having: a gate connected to the drain of the third switching element and the base of a first switching element; a drain connected to the load resistor; and a source connected to the ground terminal.

11. The power supply according to claim 8, wherein the voltage comparator comprises:

a resistor connected to a base of a second switching element; and a diode having an anode connected to the resistor, and a cathode connected to one end of a resistor of the voltage detector.

12. The power supply according to claim 7, wherein the feedback control unit disconnects, increases, or decreases the output current of the power source according to the change of the reference potential in the openness detection circuit.

13. The power supply according to claim 1, wherein the feedback control unit disconnects the output current of the power source when the reference potential of the openness detection circuit is changed.

14. The power supply according to claim 1, wherein the feedback control unit comprises a comparator which compares the reference potential of the openness detection circuit and a potential of an output terminal of the light emission unit to output a signal according to the compared result.

* * * * *